US011708957B2

(12) United States Patent
Michaelis et al.

(10) Patent No.: US 11,708,957 B2
(45) Date of Patent: Jul. 25, 2023

(54) TAIL LIGHT FOR A MOTOR VEHICLE

(71) Applicant: HELLA GmbH & Co. KG, Lippstadt (DE)

(72) Inventors: Alfons Michaelis, Borchen (DE); Martin Muegge, Geseke (DE)

(73) Assignee: Hella GmbH & Co, KGaA, Lippstadt (DE)

( * ) Notice: Subject to any disclaimer, the term of this patent is extended or adjusted under 35 U.S.C. 154(b) by 0 days.

(21) Appl. No.: 17/951,315

(22) Filed: Sep. 23, 2022

(65) Prior Publication Data

US 2023/0010327 A1 Jan. 12, 2023

Related U.S. Application Data

(63) Continuation of application No. PCT/EP2021/056360, filed on Mar. 12, 2021.

(30) Foreign Application Priority Data

Mar. 26, 2020 (DE) ..... 10 2020 108 404.8

(51) Int. Cl.
*F21S 43/237* (2018.01)
*F21S 43/247* (2018.01)
*F21S 43/245* (2018.01)

(52) U.S. Cl.
CPC ..... *F21S 43/237* (2018.01); *F21S 43/245* (2018.01); *F21S 43/247* (2018.01)

(58) Field of Classification Search
CPC ..... F21S 43/237; F21S 43/245; F21S 43/247
See application file for complete search history.

(56) References Cited

U.S. PATENT DOCUMENTS 9,121,565 B2 9/2015 Marcori et al.
10,711,970 B2 7/2020 Noh et al.
11,054,105 B2 7/2021 Noh et al.
(Continued)

FOREIGN PATENT DOCUMENTS

DE 10311317 A1 9/2004
DE 102010061210 A1 6/2012
(Continued)

OTHER PUBLICATIONS

International Search Report dated Jun. 11, 2021 in corresponding application PCT/EP2021/056360.

*Primary Examiner* — Thomas M Sember
(74) *Attorney, Agent, or Firm* — Muncy, Geissler, Olds & Lowe, P.C.

(57) ABSTRACT

A taillight for a motor vehicle, comprising a light guide element, a light source, and a light emission surface. The light source emits light in the direction of a first end of the light guide element. The light guide element is designed to guide the light from the first end in the direction of a second end. The light guide element is designed to output a part of the light between the first end and the second end through the light emission surface to an environment of the taillight. The light guide element has a curved region in which the light guide element is curved away from the light emission surface. The taillight also comprises a reflector designed to reflect light emitted by the light guide element in the direction of the light emission surface. The reflector being arranged directly adjacent to the curved region.

18 Claims, 3 Drawing Sheets

(56) References Cited

U.S. PATENT DOCUMENTS

| | | | | |
|---|---|---|---|---|
| 2013/0215633 | A1 | 8/2013 | Wuerthele et al. | |
| 2014/0056016 | A1* | 2/2014 | Marcori | F21S 43/237 362/487 |
| 2020/0158309 | A1* | 5/2020 | Noh | F21S 43/50 |

FOREIGN PATENT DOCUMENTS

| | | | |
|---|---|---|---|
| DE | 102014102355 | A1 | 8/2015 |
| DE | 102014110399 | A1 | 1/2016 |
| DE | 102017119500 | A1 | 2/2019 |
| DE | 102018119334 | A1 | 2/2019 |
| DE | 102018009729 | B3 | 1/2020 |
| EP | 2681485 | A1 | 1/2014 |
| EP | 3418626 | A1 | 12/2018 |
| JP | 2011198536 | A | 10/2011 |
| JP | 2013048036 | A | 3/2013 |
| JP | 2018120708 | A | 8/2018 |

* cited by examiner

TAIL LIGHT FOR A MOTOR VEHICLE

This nonprovisional application is a continuation of International Application No. PCT/EP2021/056360, which was filed on Mar. 12, 2021, and which claims priority to German Patent Application No. 10 2020 108 404.8, which was filed in Germany on Mar. 26, 2020, and which are both herein incorporated by reference.

BACKGROUND OF THE INVENTION

Field of the Invention

The present invention relates to a taillight for a motor vehicle.

Description of the Background Art

Taillights with light guide elements are known. Frequently, the light guide elements should extend over as much of the entire width of the motor vehicle as possible so that the motor vehicle is clearly visible over its entire width even in the dark.

A taillight with a light source and with a light guide element, in which the light of the light source is radiated in the direction of a first end of the light guide element, is known from DE 10 2018 009 729 B3. The light is then guided from the first end to a second end of the light guide element and radiated in a region between the two ends. The light guide element has a curved region. Arranged adjacent to this curved region is a light body, which passes onward the light emitted by the light guide element in the curved region. Both the light guide element and the light body have a front region through which the light is emitted. The emitted light is emitted by the taillight through an optical diffuser to the taillight's environment.

SUMMARY OF THE INVENTION

It is therefore an object of the present invention to provide an improved utilization of the light produced by the light source.

The taillight comprises a light guide element, a light source, and a light emission surface. The light source is designed to emit light in the direction of a first end of the light guide element. The light guide element is designed to guide the light from the first end in the direction of a second end. It is possible here for the first and second ends to be the two ends of the light guide element that are most distant from one another. The light guide element is additionally designed to output a part of the light between the first end and the second end through the light emission surface to an environment of the taillight.

The light guide element has a curved region in which the light guide is curved away from the light emission surface. The curved region can adjoin the first end, for example.

The taillight can comprise a reflector. The reflector can be designed to reflect light emitted by the light guide element in the direction of the light emission surface. The reflector can be arranged directly adjacent to the curved region. This can mean, for example, that no other component is arranged between the reflector and the curved region. It can also mean that solely an air gap is arranged between the reflector and the curved region.

The reflector is advantageous for the purpose of better utilizing the light produced by the light source and emitted by the light guide element. Because the light guide element radiates the light diffusely, light that does not reach the light emission surface and consequently does not contribute to the visibility of the taillight is radiated, especially in the curved region. Moreover, the curved region is curved away from the light emission surface, so that it is further away from the light emission surface than a central region of the light guide element adjoining the curved region. Therefore, without a reflector the taillight would appear to be darker in the area where the curved region is arranged than in the rest of the region.

The reflector can be designed to be mirror-coated or, for example, be implemented as a white, diffuse reflecting element.

The curved region of the light guide element can be arranged between the reflector and the light emission surface.

The taillight can comprise a rear wall that is arranged opposite the light emission surface. At least a part of the reflector can be arranged between the rear wall and the light guide element. In this way, the light emitted by the light guide element in the direction of the rear wall can be reflected in the direction of the light emission surface.

The reflector can have a curvature.

The curvature of the reflector can be matched to the curved region of the light guide element. For example, its radius of curvature can be matched to the radius of curvature of the curved region. It is possible, for example, for the radius of the curvature of the curvature to be identical to the radius of curvature of the curved region.

The reflector can surround the light guide element. This can mean, for example, that the reflector is arranged above, below, and to the side of the light guide element. This can be the case especially in the entire curved region or in a section of the curved region.

The taillight can comprise a light body that is arranged adjacent to the curved region between the light guide and the light emission surface. The light body can be designed to receive light from the light guide element and to emit it to the environment through the light emission surface. The light body can further improve the homogeneity of the light emitted by the taillight. The light body can be configured as described in DE 10 2018 009 729 B3, for example.

The light body can be arranged adjacent to the reflector and to the light guide element. In particular, it is possible for the light body to be arranged directly adjacent to the reflector and to the light guide element. For example, no other components can be arranged between the reflector and the light body and between the light body and the light guide element. It is possible that solely an air gap is arranged between the reflector and the light body and between the light body and the light guide element.

The light guide element can have a first boundary pointing in the direction of the light emission surface. The first boundary can define a geometric straight line. The geometric straight line can, for example, be the straight line on which the entire first boundary lies. It is also possible that the geometric straight line is the straight line on which a section of the light guide element adjoining the curved region lies. It is important to bear in mind here that the geometric straight line is not present as a real component, but instead merely as a virtual straight line. The light body can have a second boundary pointing in the direction of the light emission surface. The second boundary can run along the geometric straight line. This can mean, for example, that the second boundary adjoins the first boundary. This increases the homogeneity of the light emitted by the taillight and visible from outside the taillight.

The light body can be arranged between the reflector and the light emission surface.

The light guide element can be designed to diffusely radiate the light between the first end and the second end.

The taillight can also comprise a light guide element, a light source, and a light emission surface. The light source is designed to emit light in the direction of a first end of the light guide element. The light guide element is designed to guide the light from the first end in the direction of a second end. It is possible here for the first and second ends to be the two ends of the light guide element that are most distant from one another. In particular, it is possible that the first end is more than a meter distant from the second end. The light guide element is additionally designed to output a part of the light between the first end and the second end through the light emission surface to an environment of the taillight.

The light guide element has a curved region in which the light guide is curved away from the light emission surface. The curved region can adjoin the first end, for example.

The taillight can comprise a light body that comprises optical structures. The optical structures can face the light emission surface, so that the light body is designed to guide light emitted by the light guide element and to emit it in the direction of the light emission surface through the optical structures. The optical structures can, in particular, be advantageous for scattering the light, thereby increasing the homogeneity of the light that is visible from outside the taillight.

The light body can also have properties that are mentioned further above in this description.

It is also possible that the light body comprises additional optical structures that face the light guide element. The light body can be designed to receive light emitted by the light guide element through the additional optical structures. The additional optical structures can, for example, be designed as pillow optics or strip optics; or have an electric discharge machined, etched, or laser-formed structure; or have a diffractive or microoptical structure.

The optical structures can be designed as optical systems or a diffractive diffuser.

A region between the light body and the light guide element can be free of optical elements.

The optical structures can comprise an electric discharge machined, etched, or laser-formed structure, or a diffractive or microoptical diffuser structure. This increases the homogeneity of the light emitted to the environment by the taillight.

The light body can be designed as a thin-walled lens, for example. In this case, a light-deflecting reflector element can be arranged between the light guide element and the lens.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
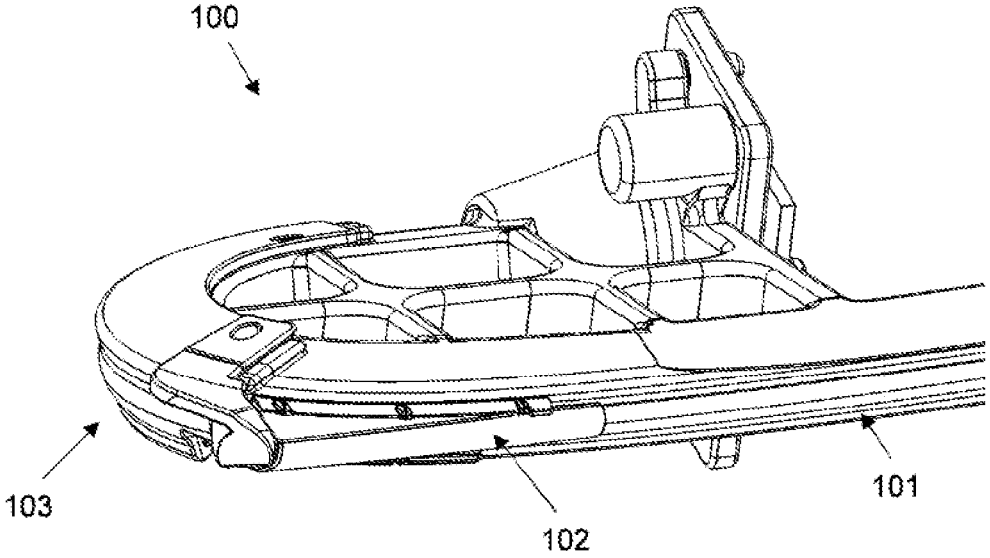
FIG. 1 is a schematic perspective view of part of a taillight according to the invention.
Figure 2:
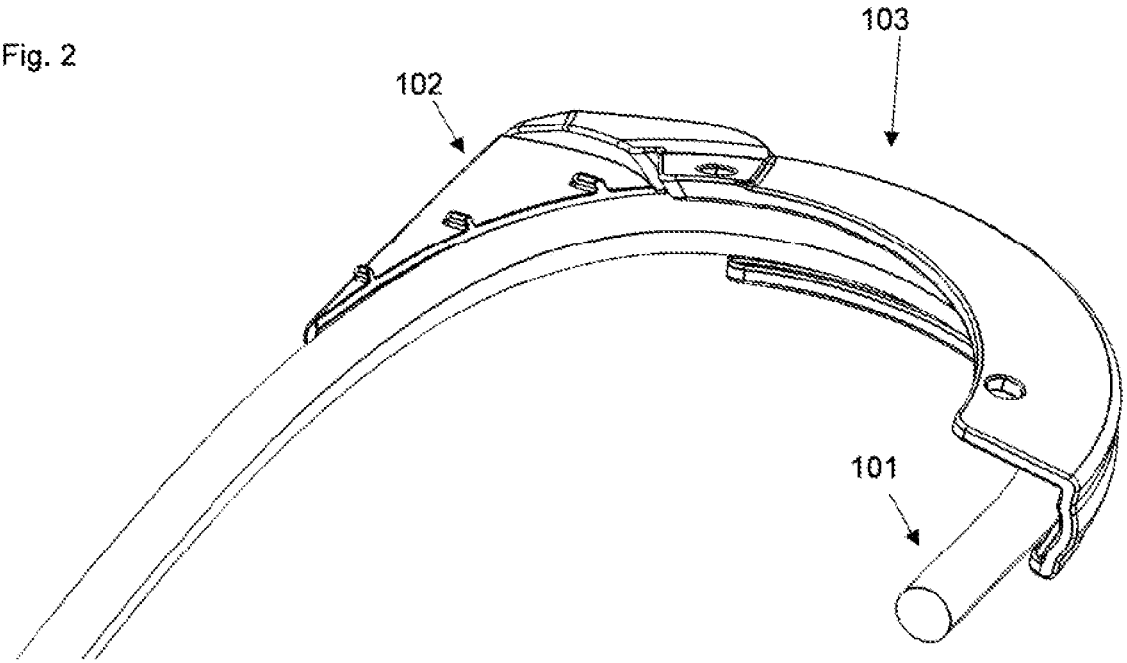
FIG. 2 is a schematic perspective view of a light guide element with reflector arranged adjacent thereto and with light body.
Figure 3:
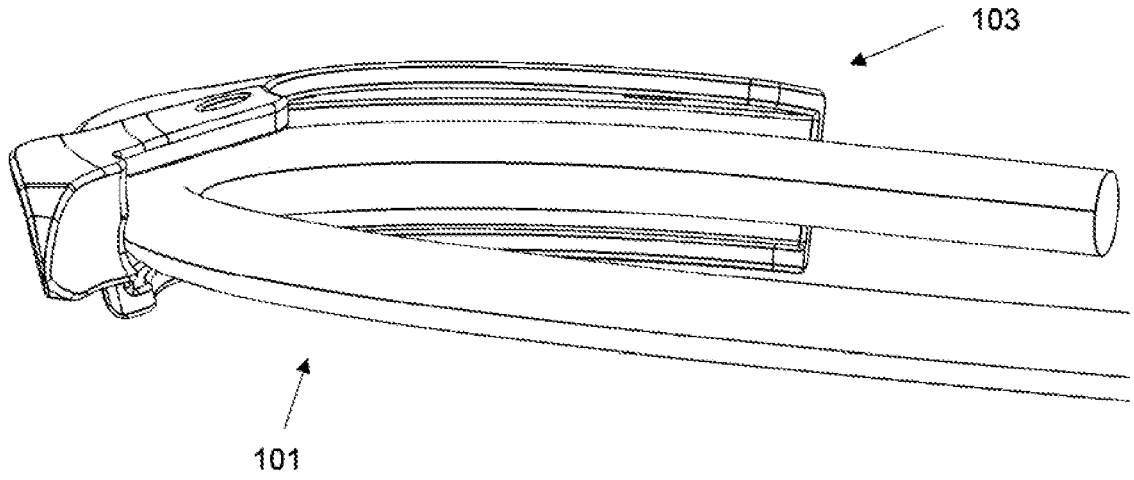
FIG. 3 is a schematic perspective view of a light guide that is surrounded by a reflector.

The taillight 100 includes a light guide element 101, a light body 102, and a reflector 103. In FIGS. 1 to 3, the light source is hidden. The light source is arranged opposite a first end of the light guide element 101 and emits light in the direction of the first end so that the light is coupled into the light guide element 101. The light guide element 101 guides the light to a second end, which is not shown in the figures. The second end is furthest distant from the first end of the light guide element 101. Between the first and second ends, the light guide element 101 diffusely radiates a part of the light.

Figure 4:
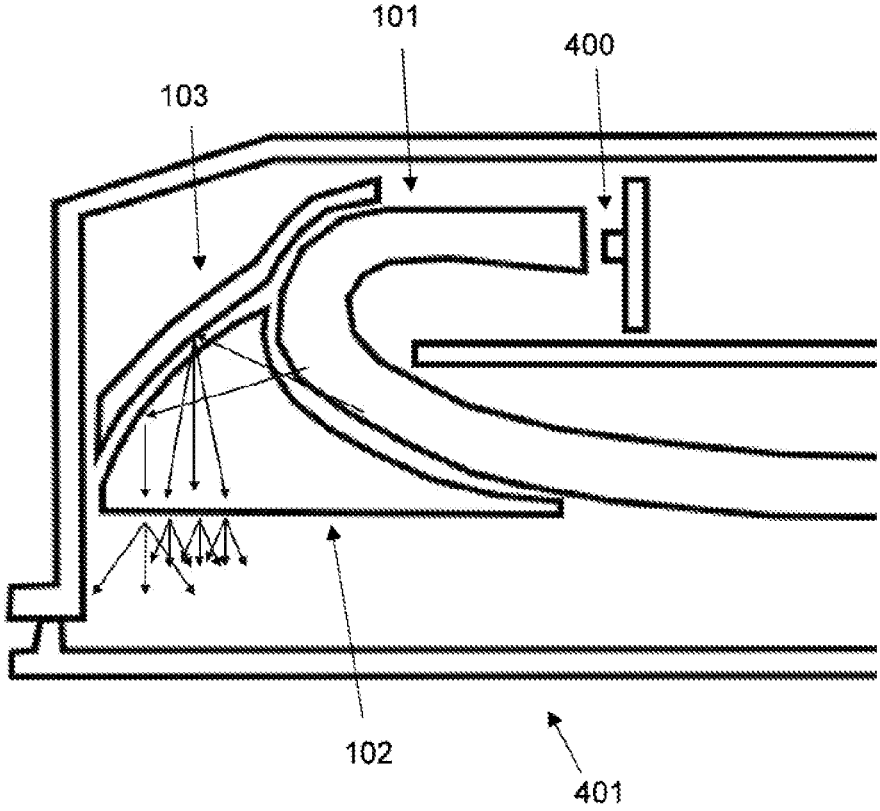
FIG. 4 is a schematic top view of a detail of a taillight according to the invention with light body.

Adjoining the first end is a curved region of the light guide element 101, which is surrounded by a reflector 103 that likewise is curved. The reflector 103 has the same radius of curvature as the curved region. The light radiated in the curved region by the light guide element 101 is reflected in the direction of a light body 102 by the reflector 103. This is represented in FIG. 4, for example, wherein the light beams are represented using some arrows by way of example. The light source 400 is also shown in FIG. 4.

The light body 102 is arranged directly adjacent to the light guide element 101 and to the reflector 103. The light body 102 receives light from the light guide element 101 and from the reflector 103 and emits it in the direction of a light emission surface (not shown) of the taillight.

It can be seen especially well in FIGS. 2 and 4 that an edge of the light body 102 facing the light emission surface 401 aligns with an end of the light guide element 101 facing the light emission surface 401. As a result, a light pattern that is especially visually appealing from outside the taillight 100 is produced.

The way the reflector 103 surrounds the light guide element 101 from above, from below, and to the side can be seen especially well in FIG. 3.

Figure 5:
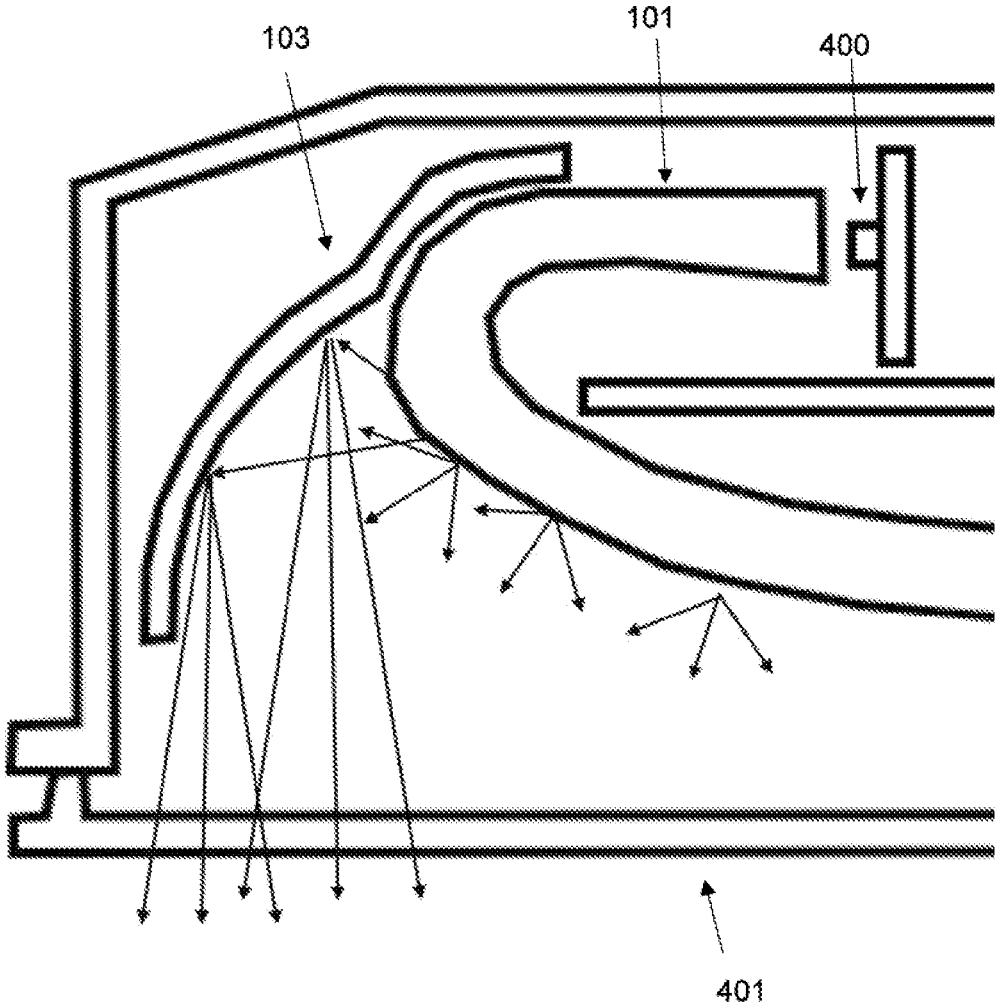
FIG. 5 is a schematic top view of a detail of a taillight according to the invention with no light body.

The embodiment shown in FIG. 5 includes no light body. This light guide element 101 emits light both directly and indirectly through the reflector 103 in the direction of the light emission surface 401. Because of the light reflected by the reflector 103, the light emitted by the taillight appears to be relatively homogeneous, even though no light body is present.

Figure 6:
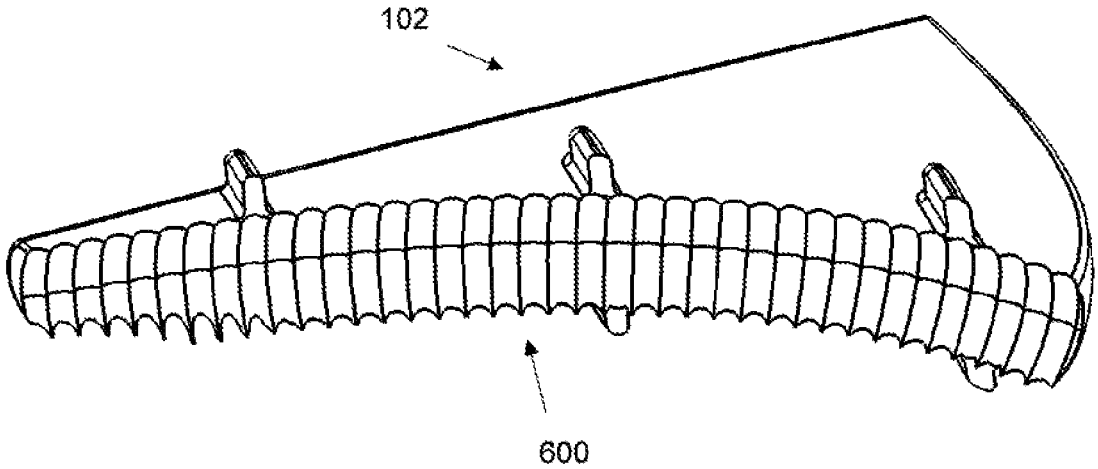
FIG. 6 is a schematic perspective view of a light body according to the invention.

The light body 102 shown in FIG. 6 has optical structures 600 on its side facing the light emission surface 401. These optical structures 600 can be electric discharge machined, etched, or produced with a laser, for example. Diffractive and/or microoptical diffuser structures can be involved here. This is advantageous for homogeneous emission of light by the taillight.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A taillight for a motor vehicle, the taillight comprising:

a light guide element;

a light source; and a light emission surface;

a reflector; and a light body, wherein the light source emits light in a direction of a first end of the light guide element, wherein the light guide element guides the light from the first end in a direction of a second end, wherein the light guide element outputs a part of the light between the first end and the second end through the light emission surface to an environment of the taillight, wherein the light guide element has a curved region in which the light guide element is curved away from the light emission surface, wherein the reflector reflects light emitted by the light guide element in a direction of the light emission surface, wherein the reflector is arranged directly adjacent to the curved region of the light guide element, wherein the light body is arranged adjacent to the curved region between the light guide element and the light emission surface, wherein the light body is adapted to receive light from the light guide element and to emit light to the environment through the light emission surface, and wherein an entirety of a surface of the light body that faces the light guide element is concave.

2. The taillight according to claim 1, wherein the curved region of the light guide element is arranged between the reflector and the light emission surface.

3. The taillight according to claim 1, wherein the taillight comprises a rear wall that is arranged opposite the light emission surface, and wherein at least a part of the reflector is arranged between the rear wall and the light guide element.

4. The taillight according to claim 1, wherein the reflector has a curvature.

5. The taillight according to claim 4, wherein the the reflector has a same radius of curvature as the curved region of the light guide element.

6. The taillight according to claim 1, wherein the reflector surrounds the light guide element.

7. The taillight according to claim 1, wherein the light body is arranged adjacent to the reflector and to the light guide element.

8. The taillight according to claim 1, wherein the light guide element has a first boundary pointing in the direction of the light emission surface, wherein the first boundary defines a geometric straight line, wherein the light body has a second boundary pointing in the direction of the light emission surface, and wherein the second boundary runs along the geometric straight line.

9. The taillight according to claim 1, wherein the light body is arranged between the reflector and the light emission surface.

10. The taillight according to claim 1, wherein the light guide element is designed to diffusely radiate the light between the first end and the second end.

11. The taillight according to claim 1, wherein an entirety of a surface of the light body that faces the reflector is convex.

12. The taillight according to claim 1, wherein the light body is provided on a same side of the curved region of the light guide element as the reflector.

13. The taillight according to claim 1, wherein the surface of the light body that faces the light guide element faces the curved region of the light guide element.

14. The taillight according to claim 1, wherein a surface of the light body that faces the light emission surface extends along a same plane as a portion of a surface of the light guide element that faces the light emission surface and is provided between the curved region and the second end.

15. A taillight for a motor vehicle, the taillight comprising:

a light guide element;

a light source;

a light emission surface; and a light body that comprises optical structures, wherein the light source emits light in a direction of a first end of the light guide element, wherein the light guide element guides the light from the first end in a direction of a second end, wherein the light guide element outputs a portion of the light between the first end and the second end through the light emission surface to an environment of the taillight, wherein the light guide element has a curved region in which the light guide element is curved away from the light emission surface, wherein the optical structures face the light emission surface so that the light body is designed to guide light emitted by the light guide element and to emit the light in a direction of the light emission surface through the optical structures, wherein the light body is arranged adjacent to the curved region between the light guide element and the light emission surface, and wherein an entirety of a surface of the light body that faces the light guide element is concave.

16. The taillight according to claim 15, wherein the optical structures are designed as optical systems or a diffractive diffuser.

17. The taillight according to claim 15, wherein a region between the light body and the light guide element is free of optical elements.

18. The taillight according to claim 15, wherein the optical structures comprise an electric discharge machined, etched, or laser-formed structure, or a diffractive or a microoptical diffuser structure.

* * * * *